US007914267B2

(12) United States Patent
Sato et al.

(10) Patent No.: US 7,914,267 B2
(45) Date of Patent: Mar. 29, 2011

(54) MULTISTAGE COMPRESSOR FOR A CO2 CYCLE THAT INCLUDES A ROTARY COMPRESSING MECHANISM AND A SCROLL COMPRESSING MECHANISM

(75) Inventors: Hajime Sato, Aichi (JP); Yoshiyuki Kimata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 475 days.

(21) Appl. No.: 11/990,010

(22) PCT Filed: Dec. 27, 2007

(86) PCT No.: PCT/JP2007/075192

§ 371 (c)(1),
(2), (4) Date: Feb. 5, 2008

(87) PCT Pub. No.: WO2008/081899

PCT Pub. Date: Oct. 7, 2008

(65) Prior Publication Data

US 2010/0143172 A1 Jun. 10, 2010

(30) Foreign Application Priority Data

Dec. 28, 2006 (JP) ..... 2006-356169

(51) Int. Cl.
*F01C 1/30* (2006.01)
*F03C 2/00* (2006.01)

(52) U.S. Cl. ..... 418/3; 418/11; 418/55.1; 418/60; 418/97

(58) Field of Classification Search ..... 418/55.1–55.6, 418/57, 3, 11, 15, 58, 60, 65, 88, 94, 97, 418/270, DIG. 1
See application file for complete search history.

(56) References Cited

U.S. PATENT DOCUMENTS 6,672,846 B2 * 1/2004 Rajendran et al. ..... 418/55.1
2006/0165542 A1 * 7/2006 Sakitani et al. ..... 418/3

FOREIGN PATENT DOCUMENTS

JP 63-223374 9/1988

(Continued)

OTHER PUBLICATIONS

Search Report issued Feb. 5, 2008 in PCT/JP2007/075192.

*Primary Examiner* — Theresa Trieu
(74) *Attorney, Agent, or Firm* — Westerman, Hattori, Daniels & Adrian, LLP

(57) ABSTRACT

It is an object of the present invention to provide a multistage compressor employing a gas injection system for a CO2 cycle which is able to improve the compression efficiency and the compression performance thereof. In a multistage compressor (2) for a CO2 cycle (1) that carries out two-stage compression by discharging CO2 refrigerant gas compressed in a low-stage side rotary compressing mechanism (4) into a closed housing (3) and taking intermediate pressure refrigerant gas in the closed housing (3) by a high-stage side scroll compressing mechanism (5), a gas injection circuit (15) for injecting intermediate pressure CO2 refrigerant gas extracted from a refrigerant circuit into the closed housing (3) is connected to the closed housing (3), and the pressure ratios of the low-stage side rotary compressing mechanism (4) and the high-stage side scroll compressing mechanism (5) are substantially equivalent, and the ratios of displacement volume are substantially equivalent.

11 Claims, 7 Drawing Sheets

FOREIGN PATENT DOCUMENTS

| | | | |
|---|---|---|---|
| JP | 02-149787 | | 6/1990 |
| JP | 5-87074 | A | 4/1993 |
| JP | 09-236092 | | 9/1997 |
| JP | 11-294350 | | 10/1999 |
| JP | 2000-54975 | A | 2/2000 |
| JP | 2000-087892 | | 3/2000 |
| JP | 2000-291552 | | 10/2000 |
| JP | 2001-73976 | A | 3/2001 |
| JP | 2003-184776 | | 7/2003 |
| JP | 2006-152839 | A | 6/2006 |
| JP | 2007-178042 | | 7/2007 |

* cited by examiner

MULTISTAGE COMPRESSOR FOR A CO2 CYCLE THAT INCLUDES A ROTARY COMPRESSING MECHANISM AND A SCROLL COMPRESSING MECHANISM

TECHNICAL FIELD

The present invention relates to a multistage compressor suitable for applying to a supercritical refrigeration cycle (CO2 cycle) using CO2 refrigerant as an operating fluid.

BACKGROUND ART

In the related art, various types of multistage compressors applicable to an air conditioning apparatus are proposed. As a known example, there is a multistage compressor for two-stage compression in which a low-stage side rotary compressing mechanism is provided under an electric motor provided at a center portion in a closed housing, and compressed gas is discharged into the closed housing and intermediate pressure gas is taken into a high-stage side scroll compressing mechanism provided above the electric motor (for example, see Patent Document 1).

There is also proposed in Patent Document 2 a multistage compressor for two-stage compression in which an electric motor and low-stage side and high-stage side rotary compressing mechanisms are provided in the closed housing, intermediate pressure gas compressed by the low-stage side rotary compressing mechanism is discharged to a second sealed chamber provided in the closed housing, the intermediate pressure gas extracted from the side of a refrigerant circuit is injected into the second sealed chamber, and the intermediate pressure injection gas and the intermediate pressure gas compressed by the low-stage side rotary compressing mechanism are taken into the high-stage side rotary compressing mechanism.

There is proposed in Patent Document 3 a multistage compressor for two-stage compression in which R410A refrigerant is used and intermediate pressure gas compressed by a low-stage side rotary compression element is taken into a high-stage side rotary compression element via a gas pipe and the intermediate pressure gas extracted from the side of the refrigerant circuit is injected into the gas pipe, and in which the ratios of displacement volume of the low-stage side compression element and the high-stage side compression element are 1:0.65 to 1:0.85.

In Patent Document 4, there is proposed a multistage compressor for two-stage compression in which part of CO2 refrigerant gas compressed by the low-stage side rotary compression element is discharged into the closed housing, and the intermediate pressure CO2 refrigerant gas and the remaining intermediate pressure CO2 refrigerant gas is taken into the high-stage side rotary compression element via the gas pipe, and in which the volumetric ratios of the low-stage side compression element and the high-stage side compression element are 1:0.56 to 1:0.8.

[Patent Document 1] JP-A-5-87074
[Patent Document 2] JP-A-2000-54975
[Patent Document 3] JP-A-2006-152839
[Patent Document 4] JP-A-2001-73976

DISCLOSURE OF THE INVENTION

However, those disclosed in Patent Documents 1 to 3 are intended to provide a multistage compressor for a refrigeration cycle using chlorofluorocarbon refrigerant or HFC refrigerant, and hence desired compression performance cannot be obtained necessarily even when it is applied to a supercritical refrigeration cycle (CO2 cycle) using CO2 refrigerant as non-chlorofluorocarbon refrigerant as is.

In particular, in the CO2 cycle, when a system of injecting the intermediate pressure refrigerant gas extracted from the refrigerant circuit into the intermediate pressure gas discharged from the low-stage side compression element is employed, the effects depend on how the low-stage side compression element and the high-stage side compression element are combined while considering the refrigerant characteristics. Therefore, in the combination of technologies disclosed in Patent Document 1 to Patent Document 4, desired compression efficiency and compression performance are not achieved as the multistage compressor for the CO2 cycle employing a gas injection system, and hence there is still a problem to be solved.

In view of such circumstances, it is an object of the present invention to provide a multistage compressor employing a gas injection system for the CO2 cycle, which is able to improve the compression efficiency and compression performance thereof.

In order to solve the above-described problems, a multistage compressor according to the present invention includes the following solutions.

In other words, a multistage compressor according to an aspect of the present invention is a multistage compressor for a CO2 cycle that includes a low-stage side rotary compressing mechanism and a high-stage side scroll compressing mechanism driven by an electric motor in a closed housing, and carries out two-stage compression by discharging CO2 refrigerant gas compressed in the low-stage side rotary compressing mechanism into the closed housing and taking intermediate pressure refrigerant gas in the closed housing by the high-stage side scroll compressing mechanism, in which a gas injection circuit for injecting intermediate pressure CO2 refrigerant gas extracted from a refrigerant circuit into the closed housing is connected to the closed housing, and in which the pressure ratios of the low-stage side rotary compressing mechanism and the high-stage side scroll compressing mechanism are substantially equivalent, and the ratios of displacement volume are substantially equivalent.

According to the aspect described above, the refrigerant gas compressed by the low-stage side rotary compressing mechanism is discharged into the closed housing, and the intermediate pressure refrigerant gas from the refrigerant circuit is injected into the closed housing at the intermediate pressure via the gas injection circuit to allow the intermediate pressure refrigerant gas to be taken into the high-stage side scroll compressing mechanism. Therefore, an excessive pressure loss is not generated, and a high compression performance and a high COP (coefficient of performance) can be obtained owing to an economizer effect through gas injection. Since the pressure ratios of the low-stage side compressing mechanism and the high-stage side compressing mechanism are substantially equivalent, high efficiency is achieved. When pressure ratios are equivalent, the pressure difference of the high-stage side compressing mechanism is large. However, since the high-stage side compressing mechanism employed here is a scroll compressing mechanism in which the compression leakage at the time of high pressure difference is smaller than the rotary compressing mechanism, the compression efficiency of the high-stage side compressing mechanism is increased and hence the performance of a two-stage compressor is improved as much as possible. In addition, since the displacement volumes of the low-stage side rotary compressing mechanism and the high-stage side scroll compressing mechanism are substantially equivalent, a sufficient amount of refrigerant is taken into the high-stage side compressing mechanism even in the case of CO2 refrigerant which has high dryness function for the intermediate pressure refrigerant gas in the refrigerant characteristics. Therefore, the gas injection effects can be demonstrated satisfactorily and the compression efficiency and the compression performance of the two-stage compression can be sufficiently improved.

In addition, the multistage compressor in the aspect described above, the ratio of displacement volume in the multistage compressor described above may be 1:0.8 to 1:1.

In this configuration, the range of the ratios of displacement volume of the low-stage side compressing mechanism and the high-stage side compressing mechanism, which are substantially equivalent, is 1:0.8 to 1:1. Therefore, the ratio of displacement volume is sufficiently larger than the displacement volume which is considered to be optimal in the case of the CO2 refrigerant multistage compressor without gas injection (approximately 1:0.6 to 1:0.8), and hence the refrigerant gas is allowed to be taken into the high-stage side compressing mechanism sufficiently even with the multistage compressor employing a system of injecting the intermediate pressure refrigerant gas into the closed housing. Therefore, the gas injection effect is sufficiently demonstrated and the compression performance and the COP may be improved as much as possible.

In any one of the multistage compressors described above, the multistage compressor in the aspect described above may be configured in such a manner that the low-stage side rotary compressing mechanism is provided on one side of the electric motor provided at the center portion of the closed housing so as to be connected to a crank portion provided at one end of a drive shaft driven by the electric motor, and the high-stage side scroll compressing mechanism is provided on the other side of the electric motor so as to be connected to a crank pin portion provided at the other end of the drive shaft.

In this configuration, the electric motor is provided at the center portion of the closed housing, the low-stage side rotary compressing mechanism is connected to the one end side of the drive shaft, and the high-stage side scroll compressing mechanism is connected to the other end side thereof. Therefore, the high-efficiency and high-performance multistage compressor may be manufactured with the combination of the rotary compressing mechanism and the scroll compressing mechanism having different configuration.

In any one of the multistage compressors described above, the multistage compressor in the aspect described above may be configured in such a manner that the low-stage side rotary compressing mechanism and the high-stage side scroll compressing mechanism are provided with an oil supply pump for supplying lubricating oil filled in the closed housing to required points of lubrication via oil supply holes provided in the drive shafts thereof, and the oil supply pump is a positive displacement oil supply pump.

In the multistage compressor in which the pressure in the closed housing is an intermediate pressure, it is difficult to supply lubricating oil filled in the closed housing to the high-stage side scroll compressing mechanism with the pressure difference. Therefore, in the present invention, the positive displacement oil supply pump having a high oil supply performance can be employed as an oil supply pump, and hence oil supply is reliably achieved for the required points of lubrication respective in the low-stage side compressing mechanism and the high-stage side compressing mechanism even with the multistage compressor in which the pressure in the closed housing is the intermediate pressure. Therefore, the stable lubrication can be achieved in both of the compressors.

In addition, in any one of the multistage compressors described above, the multistage compressor in the aspect described above may be configured in such a manner that the gas injection circuit is connected to the closed housing at a position on the opposite side of the axial line of the drive shaft of the compressing mechanism from the position of an oil discharge hole through which the lubricating oil after having lubricated the compressing mechanism is discharged in the range defined by a line orthogonal to the axial line of the drive shaft.

In this configuration, since the gas injection circuit is connected to the closed housing at the position on the opposite side of the axial line of the drive shaft of the compressing mechanism from the position of the oil discharge hole, a sufficient distance is secured between the oil discharge hole and the point of connection of the gas injection circuit, and hence the refrigerant gas injected into the closed housing can be prevented from coming into contact with the lubricating oil discharged from the oil discharge hole and whirling the lubricating oil upward. Accordingly, unnecessary discharge of the lubricating oil (oil discharge out of the compressor) can be prevented, and lowering of the volumetric efficiency of the high-stage side compressing mechanism by excessive mixing of the lubricating oil into the intermediate pressure refrigerant gas can be also prevented, so that the performance of the multistage compressor is improved.

In any one of the multistage compressors described above, the multistage compressor in the aspect described above may be configured in such a manner that a shielding panel is provided in the closed housing so as to oppose to an opening of the gas injection circuit toward the interior of the closed housing.

In this configuration, since the shielding panel is provided so as to oppose the opening of the gas injection circuit, the refrigerant gas injected into the closed housing and the lubricating oil dropped down into the closed housing after having lubricated the compressing mechanisms can be separated by the partitioning function of the shielding panel, so that the lubrication oil is prevented from whirling upward by the injected refrigerant gas. Accordingly, unnecessary discharge of the lubricating oil (oil discharge out of the compressor) can be prevented, and lowering of the volumetric efficiency of the high-stage side compressing mechanism by excessive mixing of the lubricating oil into the intermediate pressure refrigerant gas can be also prevented, so that the performance of the multistage compressor is improved.

In any one of the multistage compressors described above, the multistage compressor in the aspect described above may be configured in such a manner that the gas injection circuit is connected to and opening toward the interior of the closed housing at a position opposing a stator coil end of the electric motor.

In this configuration, since the gas injection circuit is connected to and opening toward the interior of the closed housing at the position opposing the stator coil end of the electric motor, the refrigerant gas injected into the closed housing the partitioning function of the stator coil end and the lubricating oil dropped down in the closed housing after having lubricated the compressing mechanism can be separated, and hence the lubricating oil can be prevented from whirling upward by the injected refrigerant gas. Accordingly, unnecessary discharge of the lubricating oil (oil discharge out of the compressor) can be prevented, and lowering of the volumetric efficiency of the high-stage side compressing mechanism by excessive mixing of the lubricating oil into the intermediate pressure refrigerant gas can be also prevented, so that the performance of the multistage compressor is improved. In addition, the motor stator can be cooled by the injected refrigerant gas, and hence the motor efficiency can be improved.

In any one of the multistage compressors described above, the multistage compressor in the aspect described above may be configured in such a manner that the gas injection circuit is connected to and opened toward the interior of the closed housing obliquely toward the high-stage side scroll compressing mechanism.

In this configuration, since the gas injection circuit is connected to and opening toward the interior of the closed hosing obliquely toward the high-stage side scroll compressing mechanism, the refrigerant gas injected obliquely toward the high-stage side scroll compressing mechanism is taken into the high-stage side scroll compressing mechanism as is. Therefore, the lubricating oil dropped down into the closed housing after having lubricated the compressing mechanism can be prevented from whirling upward by the injection gas. Accordingly, unnecessary discharge of the lubricating oil (oil discharge out of the compressor) can be prevented, and lowering of the volumetric efficiency of the high-stage side compressing mechanism by excessive mixing of the lubricating oil into the intermediate pressure refrigerant gas can be also prevented, so that the performance of the multistage compressor is improved.

In any one of the multistage compressors described above, the multistage compressor in the aspect described above may be configured in such a manner that the low-stage side rotary compressing mechanism and/or the high-stage side scroll compressing mechanism includes the oil discharge hole for discharging the lubricating oil after having lubricated required points into the closed housing, and the oil discharge hole is provided with an oil discharge guide for guiding the discharged oil into an oil trap in the closed housing.

In this configuration, since the oil discharge guide for guiding the discharged oil into the oil trap in the closed housing is provided on the oil discharge hole provided on the low-stage side rotary compressing mechanism and/or the high-stage side scroll compressing mechanism, the refrigerant gas injected into the closed housing and the lubricating oil discharged from the oil discharge hole into the closed housing after having lubricated the compressing mechanism can be separated by the partitioning function of the oil discharge guide, so that the lubricating oil is prevented from whirling upward by the injected refrigerant gas. Accordingly, unnecessary discharge of the lubricating oil (oil discharge out of the compressor) can be prevented, and lowering of the volumetric efficiency of the high-stage side compressing mechanism by excessive mixing of the lubricating oil into the intermediate pressure refrigerant gas can be also prevented, so that the performance of the multistage compressor is improved.

In any one of the multistage compressors described above, the multistage compressor in the aspect described above may be configured in such a manner that the gas injection circuit is connected to and opening toward the interior of the closed housing at a position between the electric motor and the high-stage side scroll compressing mechanism.

In this configuration, since the gas injection circuit is connected to and opened toward the interior of the closed housing at a position between the electric motor and the high-stage side scroll compressing mechanism, the refrigerant gas injected into the closed housing can be prevented from being heated by the electric motor. Therefore, the intake efficiency of the high-stage side scroll compressing mechanism is improved and the performance of the multistage compressor can be improved.

In any one of the multistage compressors described above, the multistage compressor in the aspect described above may be configured in such a manner that the gas injection circuit is connected to and opening toward the interior of the closed housing at a position between the electric motor and the low-stage side rotary compressing mechanism.

In this configuration, since the gas injection circuit is connected to and opening toward the interior of the closed housing at the position between the electric motor and the low-stage side rotary compressing mechanism, the refrigerant gas injected into the closed housing flows around the electric motor. Accordingly, the electric motor can be cooled. Consequently, the motor efficiency is improved and the performance of the multistage compressor can be improved.

According to the present invention, an excessive pressure loss is not generated during gas injection, and hence a high compression performance and a high COP (coefficient of performance) can be obtained owing to an economizer effect through gas injection. Since the pressure ratios of the low-stage side compressing mechanism and the high-stage side compressing mechanism are equivalent and the high-stage side compressing mechanism in which the pressure difference is increased in this case is a scroll compressing mechanism in which the compression leakage at the time of high pressure difference is relatively small, the compression efficiency of the high-stage side compressing mechanism is increased, and the performance as the two-stage compressor can be improved as much as possible. In addition, the displacement volumes of the low-stage side rotary compressing mechanism and the high-stage side scroll compressing mechanism are substantially equivalent, so that a sufficient amount of refrigerant can be taken into the high-stage side compressing mechanism in the case of the CO2 refrigerant which has high dryness function for the intermediate pressure refrigerant gas. Therefore, the gas injection effects are demonstrated satisfactorily and the compression efficiency and the compression performance of the two-stage compression can be sufficiently improved.

EXPLANATION OF REFERENCE

Figure 1:
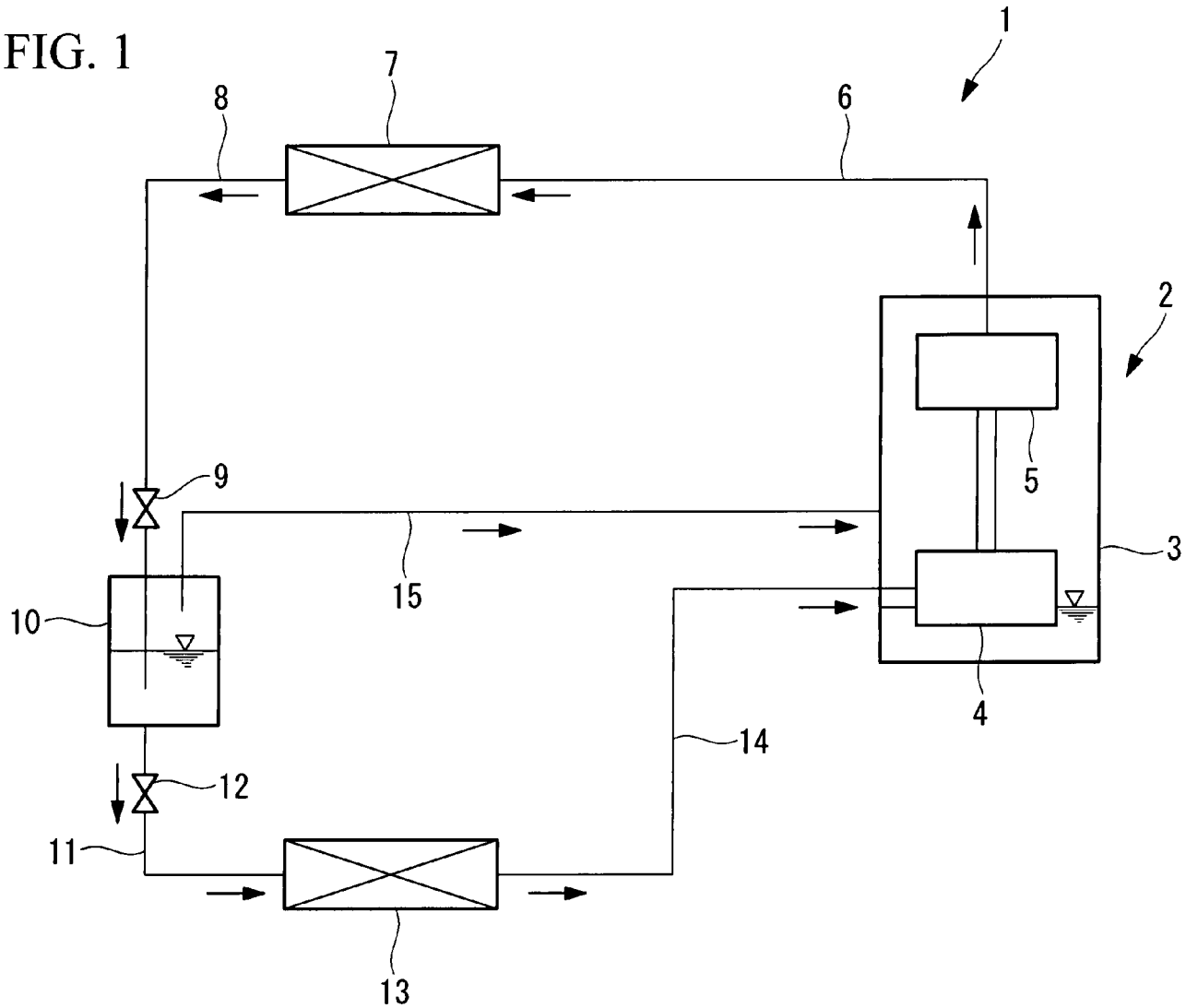
FIG. 1 is a block diagram showing a CO2 cycle to which a multistage compressor according to a first embodiment of the present invention is applied.

1: CO2 cycle
2: multistage compressor
3: closed housing
4: low-stage side rotary compressing mechanism (low-stage side compressing mechanism)
5: high-stage side rotary compressing mechanism (high-stage side compressing mechanism)
15: gas injection circuit
20: positive displacement oil supply pump
21: oil supply hole
31: electric motor
34, 35, 36: crankshaft (drive shaft)
35A: crank portion
36A: crank pin
37: lubricating oil
65: oil discharge hole
66: shielding panel
67: stator coil end
68: oil discharge guide
p: axial line of drive shaft
Q: line which is orthogonal to axial line

BEST MODE FOR CARRYING OUT THE INVENTION

Referring now to the drawings, embodiments of the present invention will be described.

First Embodiment

Referring to FIG. 1 to FIG. 4, a first embodiment of the present invention will be described.

FIG. 1 shows a block diagram of a CO2 cycle (a supercritical refrigeration cycle using CO2 refrigerant) 1 using a multistage compressor 2 according to the first embodiment of the present invention. The CO2 cycle 1 includes the multistage compressor 2 in which two compressing mechanisms; a low-stage side compressing mechanism 4 and a high-stage side compressing mechanism 5 are provided in one single closed housing 3. The configuration of the multistage compressor 2 will be described later in detail.

A discharge pipe 6 is connected to the high-stage side compressing mechanism 5 of the multistage compressor 2, and the other end of the discharge pipe 6 is connected to a radiator 7. High-temperature, high-pressure refrigerant gas discharged from the multistage compressor 2 is heat-exchanged with outside air sent by a radiator fan (not shown) and cooled in the radiator 7. A vapor-liquid separator 10 is provided at downstream of the radiator 7 via a refrigerant pipe 8 and a first reducing valve 9, and refrigerant depressurized by the first reducing valve 9 is separated into vapor and liquid. An evaporator 13 is connected to the downstream of the vapor-liquid separator 10 via a refrigerant pipe 11 and a second reducing valve 12.

In the evaporator 13, vapor-liquid two-phase refrigerant at a low temperature and a low pressure depressurized via the second reducing valve 12 is heat-exchanged with air sent by an evaporator fan (not shown) and absorbs heat from the air and evaporatively emitted. The refrigerant evaporated by the evaporator 13 is adapted to be taken into the low-stage side compressing mechanism 4 of the multistage compressor 2 via an intake pipe 14 connected between the evaporator 13 and the multistage compressor 2.

A gas injection circuit 15 for injecting intermediate pressure refrigerant gas separated by the vapor-liquid separator 10 into the closed housing 3 is connected between the vapor-liquid separator 10 and the closed housing 3 of the multistage compressor 2.

Figure 2:
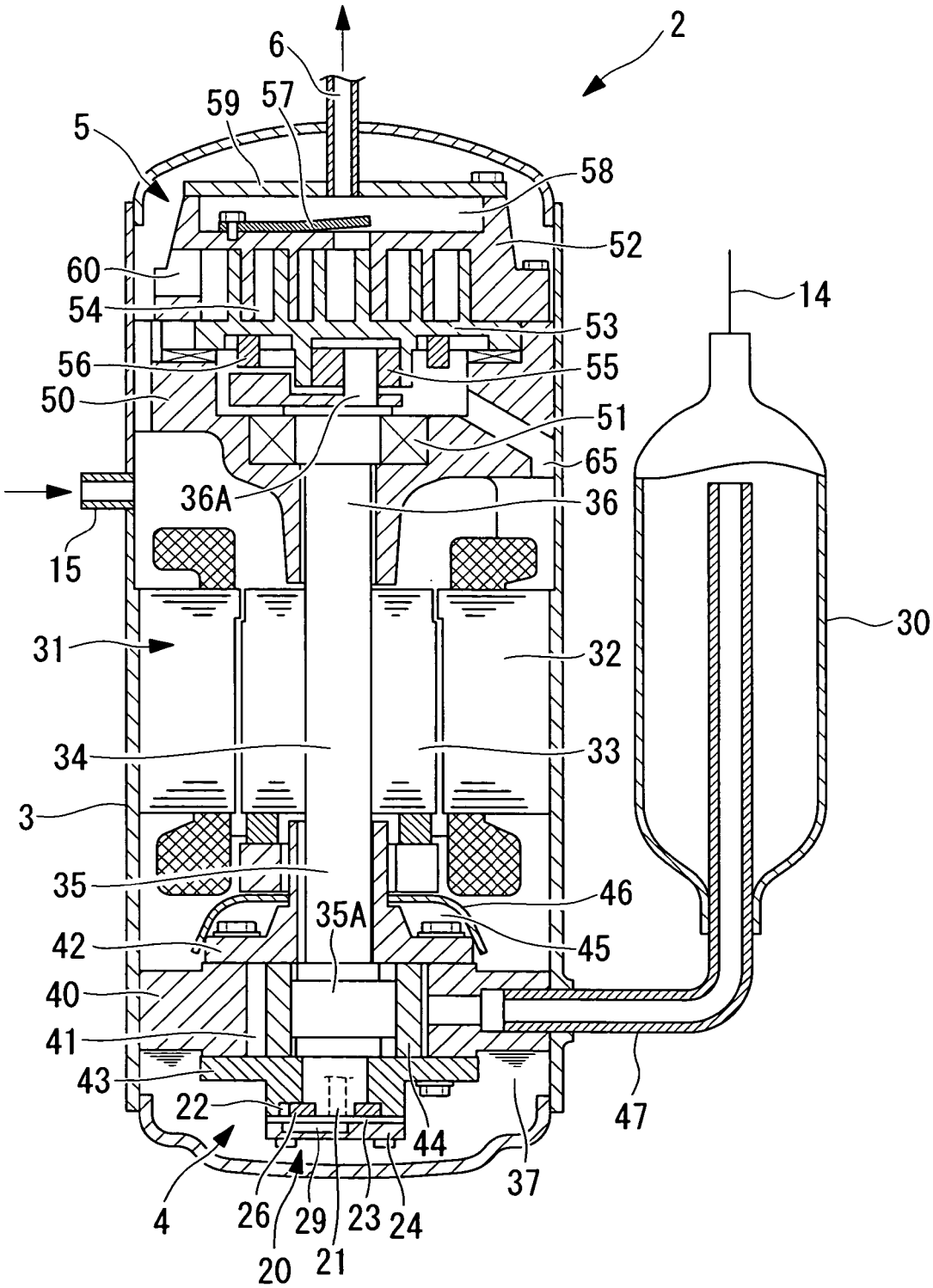
FIG. 2 is a vertical cross-sectional view of the multistage compressor according to the first embodiment of the present invention.

Referring now to FIG. 2, the configuration of the multistage compressor 2 will be described.

The multistage compressor 2 has a configuration in which the low-stage side compressing mechanism 4 is provided in a lower portion in the closed housing 3, and the high-stage side compressing mechanism 5 is provided in an upper portion thereof. An accumulator 30 to which the intake pipe 14 is connected is provided integrally with the multistage compressor 2. An electric motor 31 including a stator 32 and a rotor 33 is provided at a center portion of the closed housing 3, and a crankshaft 34 is connected integrally with the rotor 33. The lower end portion of the crankshaft 34 corresponds to a crankshaft 35 for the low-stage side compressing mechanism 4, and an upper end portion corresponds to a crankshaft 36 for the high-stage side compressing mechanism 5. Lubricating oil 37 is filled by a predetermined amount at the bottom of the closed housing 3. The lubricating oil 37 is adapted to be supplied to required points of lubrication in the low-stage side compressing mechanism 4 and the high-stage side compressing mechanism 5 via an oil supply hole 21 formed in the axial direction of the crankshaft 34 by a positive displacement oil supply pump 20, described later, provided at the lower end portion of the crankshaft 34.

The low-stage side compressing mechanism 4 includes a rotary type compressing mechanism. The rotary type compressing mechanism 4 may be a general rotary type compressing mechanism having a cylinder chamber 41, and including a cylinder body 40 to be fixedly provided on the closed housing 3, an upper bearing 42 and a lower bearing 43 disposed respectively on the top and the bottom of the cylinder body 40, a rotor 44 fitted to a crank portion 35A of the crankshaft 35 so as to be capable of sliding rotation in the cylinder chamber 41, a discharge cover 46 forming a discharge cavity 45, and a blade and a blade holding spring (not shown).

In the low-stage side rotary type compressing mechanism 4, refrigerant gas taken into the cylinder chamber 41 via an intake pipe 47 connected to the accumulator 30 is compressed to an intermediate pressure by the rotation of the rotor 44, and then is discharged into the discharge cavity 45 and is discharged into the closed housing 3 via a discharge port provided on the discharge cover 46.

The refrigerant gas at the intermediate pressure discharged into the closed housing 3 flows through an air gap or the like of the electric motor 31 into an upper space of the closed housing 3, is joined with the intermediate pressure refrigerant gas injected from the gas injection circuit 15 connected to the closed housing 3 into the closed housing 3, and then is taken into the high-stage side compressing mechanism 5.

The gas injection circuit 15 is connected to the closed housing 3 at a point between the electric motor 31 and the high-stage side compressing mechanism 5.

The high-stage side compressing mechanism 5 includes a scroll type compressing mechanism.

The scroll type compressing mechanism 5 may be a general scroll type compressing mechanism including a frame member 50 having a bearing 51 that supports the crankshaft 36 and being fixedly provided on the closed housing 3, a fixed scroll 52 and an orbiting scroll 53 which are supported on the frame member 50 and define a pair of compression chambers 54 by being meshed with each other at a phase shifted from each other, a drive bush 55 connecting the orbiting scroll 53 and a crank pin 36A provided at the axial end of the crankshaft 36 for driving the orbiting scroll 53 to orbit, an Oldham ring 56 provided between the orbiting scroll 53 and the supporting frame 50 for preventing the orbiting scroll 53 from rotating by itself and allowing the same to do an orbiting motion, a discharge valve 57 provided on the back face of the fixed scroll 52, a discharge cover 59 fixedly provided on the back face of the fixed scroll 52 so as to define a discharge chamber 58 between the fixed scroll 52 and the discharge cover 59, and the like.

In the high-stage side scroll type compressing mechanism 5, the discharge pipe 6 is connected to the discharge chamber 58 to discharge refrigerant gas compressed to a high temperature and a high pressure out of the compressor.

In the high-stage side scroll type compressing mechanism 5, intermediate pressure refrigerant gas compressed by the low-stage side rotary type compressing mechanism 4 to the intermediate pressure and discharged into the closed housing 3 and intermediate pressure refrigerant gas injected from the gas injection circuit 15 into the closed housing 3 are mixed in the closed housing 3, and then taken into the pair of compression chambers 54 via an intake port 60. The pair of compression chambers 54 are moved toward the center while being reduced in capacity by the orbiting motion of the orbiting scroll 53 and are joined into one single compression chamber 54. During this period, the refrigerant gas is compressed from the intermediate pressure to a high pressure (discharge pressure), and is discharged from the center portion of the fixed scroll 52 via the discharge valve 57 into the discharge chamber 58. The high-temperature, high-pressure refrigerant gas is discharged out of the multistage compressor 2 via the discharge pipe 6.

Figure 3:
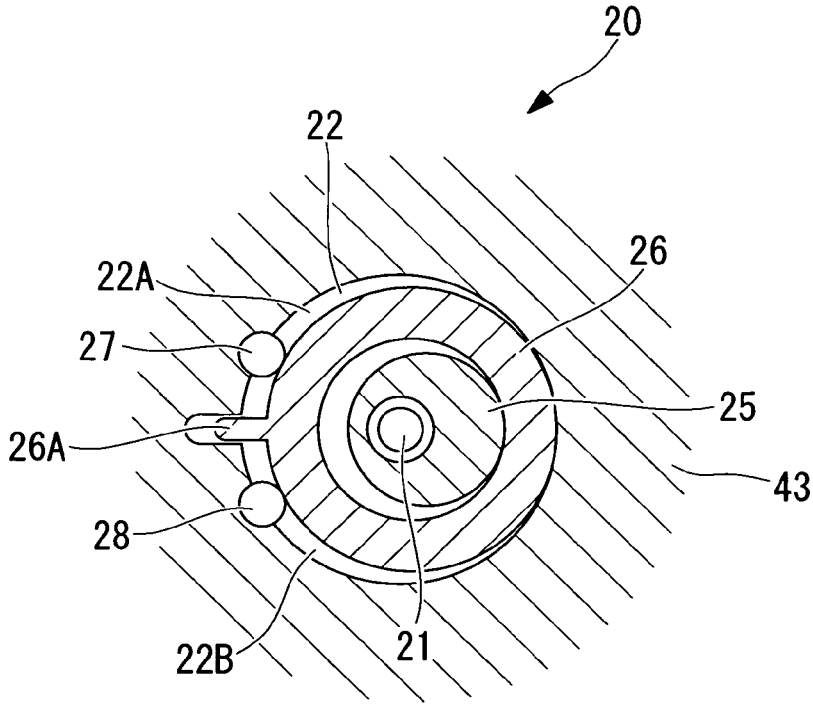
FIG. 3 is a lateral cross-sectional view of a positive displacement oil supply pump applied to the multistage compressor shown in FIG. 2.

As shown in FIG. 2 and FIG. 3, the positive displacement oil supply pump 20 defines a cylinder chamber 22 hermetically closed at a lower opening portion by a thrust plate 23 and a cover plate 24 at the lower bearing 43 which constitutes the low-stage side rotary compressing mechanism 4, and a rotor 26 fitted on an eccentric shaft 25 formed at the lower end of the crankshaft 34 to make the orbiting motion while being sliding contact with the inner peripheral surface of the cylinder chamber 22 is fitted into the cylinder chamber 22. The rotor 26 is integrally provided with a blade 26A which partitions the interior of the cylinder chamber 22 into an oil supply chamber 22A and an oil discharge chamber 22B. The lubricating oil 37 filled in the closed housing 3 is taken into the oil supply chamber 22A via an intake port 27, is discharged from the oil discharge chamber 22B to the discharge port 28, and is supplied through a communication channel 29 to an oil supply hole 21 by the positive displacement oil supply pump 20.

The positive displacement oil supply pump 20 is described here for illustrative only, and any types of positive displacement oil supply pump may be employed in this case.

In this embodiment, the relation between the low-stage side rotary compressing mechanism 4 and the high-stage side scroll compressing mechanism 5 in the multistage compressor 2 described above are configured as shown below.

The low-stage side rotary compressing mechanism 4 and the high-stage side scroll compressing mechanism 5 are configured to have the substantially equivalent pressure ratio so as to achieve the highest efficiency in the case of the two-stage compression.

The low-stage side rotary compressing mechanism 4 and the high-stage side scroll compressing mechanism 5 are configured to have the substantially equivalent ratio of displacement volume on a premise of the equivalent pressure ratio described above.

To have the substantially equivalent ratio of displacement volume means that the ratios of the displacement volume V1 of the low-stage side rotary compressing mechanism 4 and the displacement volume V2 of the high-stage side scroll compressing mechanism 5 (V1:V2) are 1:0.8 to 1:1.

Operations of the refrigeration cycle 1 and the multistage compressor 2 will be described below. In the low-stage side rotary compressing mechanism 4 of the multistage compressor 2, low pressure refrigerant gas is taken from the accumulator 30 directly into the cylinder chamber 41 via the intake pipe 47. The refrigerant gas is compressed to the intermediate pressure by the rotation of the rotor 44 via the electric motor 31 and the crankshaft 35, and then discharged into the discharge cavity 45, and then is discharged from the discharge cavity 45 through a discharge port provided on the discharge cover 46 into the closed housing 3. Accordingly, the interior of the closed housing 3 is brought into an intermediate pressure atmosphere, so that the temperatures of the electric motor 31 and the lubricating oil 37 are substantially the same as the intermediate pressure refrigerant.

The refrigerant gas at the intermediate pressure separated by the vapor-liquid separator 10 is injected into the closed housing 3 at the intermediate pressure atmosphere via the gas injection circuit 15.

The intermediate pressure refrigerant gas described above is mixed in the closed housing 3, and is taken into the compression chambers 54 of the high-stage side scroll compressing mechanism 5 through the intake port 60 opening into the closed housing 3. In the scroll compressing mechanism 5, the compression operation is achieved when the electric motor 31 is driven and the orbiting motion of the orbiting scroll 53 with respect to the fixed scroll 52 via the crankshaft 36, the crank pin 36A and the drive bush 55. Accordingly, the intermediate pressure refrigerant gas described above is compressed to a high-pressure state, and is discharged into the discharge chamber 58 via the discharge valve 57.

The high-temperature, high-pressure refrigerant gas discharged into the discharge chamber 58 is discharged from the multistage compressor 2 via the discharge pipe 6 connected to the discharge chamber 58, and is introduced into the radiator 7 as shown in an arrow in a solid line shown in FIG. 1. The refrigerant gas is heat-exchanged with air sent by the radiator fan in the radiator 7 and is discharged toward the air, so as to be brought into a supercritical state or a condensed state. The refrigerant is passed through the refrigerant pipe 8 and is depressurized by the first reducing valve 9, thereby being brought into a vapor-liquid two-phase state, reaches the vapor-liquid separator 10, where it is separated into intermediate pressure liquid refrigerant and intermediate pressure gas refrigerant. The separated intermediate pressure gas refrigerant passes through the gas injection circuit 15, and is injected into the closed housing 3 as described above. On the other hand, the intermediate pressure liquid refrigerant passes through the refrigerant pipe 11, is depressurized again by the second reducing valve 12, and reaches the evaporator 13 in a state of low pressure vapor-liquid two-phase refrigerant.

The low-pressure, low-temperature vapor-liquid two-phase refrigerant is heat-exchanged with air sent from the evaporator fan while flowing in the evaporator 13 and is evaporatively emitted by absorbing heat from the air side. The low-pressure refrigerant gas passes through the intake pipe 14 and reaches the accumulator 30 provided integrally with the multistage compressor 2, where liquid content (including oil)

is separated, and only gas content is taken into the low-stage side rotary compressing mechanism 4 via the intake pipe 47, and is compressed again.

While the cycle described above is repeated, space heating or heating can be achieved by using discharged heat from the radiator 7, and space cooling or cooling can be achieved by using the heat-absorbing operation of the evaporator 13.

During the above described cycles, in the multistage compressor 2, the lubricating oil 37 filled in the closed housing 3 is supplied to a required points of oil supply in the low-stage side rotary type compressing mechanism 4 and the high-stage side scroll type compressing mechanism 5 via the oil supply hole 21 by the positive displacement oil supply pump 20, so that the both compressing mechanisms 4, 5 are reliably lubricated. In other words, the lubricating oil 37 in the closed housing 3 is taken from the intake port 27 into the oil supply chamber 22A, is discharged from the oil discharge chamber 22B to the discharge port 28 by the rotating motion of the rotor 26, and is sent to the oil supply hole 21 via the communication channel 29. With this oil supply operation of the positive displacement oil supply pump 20, oil supply is reliably achieved also for the high-stage side scroll type compressing mechanism 5 in which pressure-difference oil supply is difficult to achieve.

Figure 4:
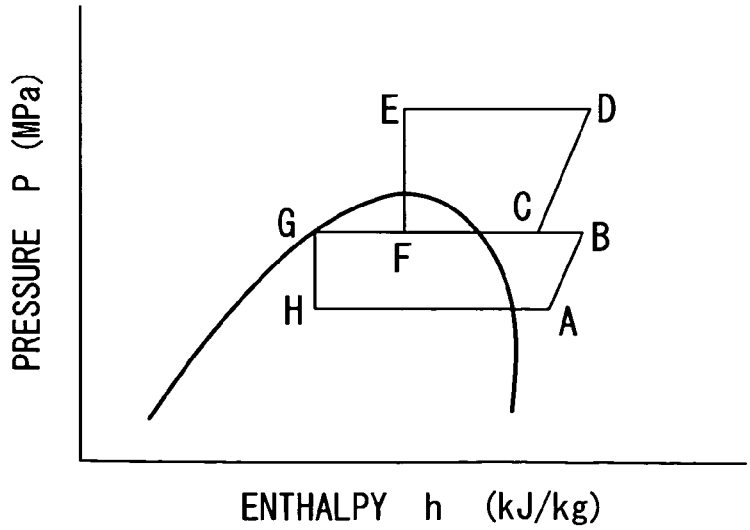
FIG. 4 is a P-h diagram of the CO2 cycle shown in FIG. 1.

FIG. 4 shows a P-h diagram of the refrigeration cycle shown above. The change of the refrigerant characteristics will be described on the basis of this diagram. Low-pressure refrigerant taken into the multistage compressor 2 is compressed by the low-stage side rotary type compressing mechanism 4 from a point A to a point B, is then discharged into the closed housing 3, and is joined with the intermediate pressure refrigerant gas injected from the gas injection circuit 15 and is brought into a state of a point C. In this state, it is taken into the high-stage side scroll type compressing mechanism 5 and is compressed again. The high-pressure refrigerant gas compressed to a point D by the high-stage side scroll type compressing mechanism 5 is cooled by discharging heat in the radiator 7, and is brought into a supercritical state or a condensed state at a point E.

Accordingly, the refrigerant in the state of the supercritical state or the condensed state is depressurized to a point F by the first reducing valve 9 to be vapor-liquid two-phase intermediate pressure refrigerant, and is separated into the intermediate pressure gas refrigerant and the intermediate pressure liquid refrigerant in the vapor-liquid separator 10. The intermediate pressure gas refrigerant is injected into the closed housing 3 via the gas injection circuit 15, is joined with the refrigerant at the point B, and is brought into the state of the point C. The intermediate pressure liquid refrigerant cooled by the separation of the intermediate pressure gas refrigerant in the vapor-liquid separator 10 and brought into a state of a point G is further depressurized by the second reducing valve 12 so that the low-pressure refrigerant of vapor-liquid two-phase low-pressure refrigerant represented by a point H is obtained. This low-pressure two-phase refrigerant reaches the evaporator 13, absorbs heat from air and hence is evaporated, and then is changed to the point A and is returned to the multistage compressor 2.

Consequently, at the time of space heating or heating, the intermediate pressure refrigerant is added to the refrigerant flowing in the radiator 7 by gas injection. Therefore, the amount of circulation of the refrigerant is increased, and the space heating or heating performance is improved correspondingly. In the case of space cooling or cooling, the enthalpy of the refrigerant at the point H is increased from the point F to the point G, and hence the amount of heat of the refrigerant evaporated in the evaporator 13 is increased, so that the space cooling or cooling performance is improved correspondingly. Furthermore, in the multistage compressor 2, a power required for compressing the refrigerant from the point A to the point D is reduced significantly by an economizer effect through gas injection.

Since the pressure ratios of the low-stage side rotary type compressing mechanism 4 and the high-stage side scroll type compressing mechanism 5 are substantially equivalent, the multistage compressor 2 is able to achieve the two-stage compression at the highest efficiency. In addition, since the ratios of displacement volume of the low-stage side rotary type compressing mechanism 4 and the high-stage side scroll type compressing mechanism 5 are 1:0.8 to 1, which are substantially equivalent, the gas injection function is sufficiently achieved by causing a sufficient amount of refrigerant to be taken into the high-stage side compressing mechanism even in the case of CO2 refrigerant which has high dryness function for the intermediate pressure refrigerant gas in the refrigerant characteristics. In other words, in the case of the CO2 refrigerant, the refrigerant gas in the intermediate stage which is expanded by one stage contains much gas content and is high in dryness function in comparison with R410A refrigerant or the like as is clear from FIG. 4 in the refrigerant characteristics. Therefore, a sufficient amount of injection gas cannot be taken in the high-stage side compressing mechanism and the gas injection effect is lowered unless the ratio of displacement volume is increased in comparison with the multistage compressor for R410A refrigerant and the multistage compressor for CO2 refrigerant of a system without gas injection shown in Patent Documents 3 and 4 described above.

Therefore, in this embodiment, since the ratio of displacement volume is sufficiently higher in comparison with the ratio of displacement volume shown in Patent Documents 3 and 4, the desired gas injection effect can be demonstrated.

Therefore, according to this embodiment, the following effects are achieved.

Since the pressure ratios of the low-stage side rotary compressing mechanism 4 and the high-stage side scroll compressing mechanism 5 are substantially equivalent, the two-stage compression at the highest efficiency can be achieved.

When the pressure ratios of the low-stage side and the high-stage side are set to be equivalent, the difference in pressure of the high-stage side compressing mechanism is large. However, since the scroll compressing mechanism having a smaller compression leakage at the high pressure difference than the rotary compressing mechanism is employed as the high-stage side compressing mechanism, the compression efficiency is increased and the performance of a two-stage compressor can be improved as much as possible.

Since a sufficient amount of refrigerant gas is taken into the high-stage side scroll compressing mechanism 5 even when the ratios of displacement volume of the low-stage side rotary compressing mechanism 4 and the high-stage side scroll compressing mechanism 5 are set to (1:0.8 to 1:1), which are substantially equivalent, and the CO2 refrigerant having the high dryness function for the intermediate pressure refrigerant gas is employed, the gas injection effects are demonstrated satisfactorily and the compression efficiency and the compression performance of the two-stage compressor can be sufficiently improved.

Since the positive displacement oil supply pump 20 which has a high oil supply performance is employed in the oil supply pump for supplying lubricating oil to the respective compressing mechanisms 4 and 5, the interior of the closed housing is maintained at the intermediate pressure. Therefore, even with the multistage compressor 2 in which pressure-difference oil supply to the high-stage side compressing mechanism is difficult to achieve, oil supply is reliably achieved for each of the required points of lubrication of the low-stage side compressing mechanism 4 and the high-stage side compressing mechanism 5. Therefore, stable lubrication can be achieved for the both compressing mechanisms.

Since the electric motor 31 is provided at the center of the closed housing 3, the low-stage side rotary compressing mechanism 4 is connected to one end side 35 of the drive shaft (crankshaft) 34, and the high-stage side scroll compressing mechanism 5 is connected to the other end side 36, manufacture of the high-performance multistage compressor 2 having the rotary compressing mechanism 4 and the scroll compressing mechanism 5 combined to each other is enabled.

Furthermore, in this embodiment, the gas injection circuit 15 is connected to a point between the electric motor 31 and the high-stage side scroll compressing mechanism 5. Therefore, the injected refrigerant gas can be prevented from being heated by the electric motor 31. Therefore, the intake efficiency of the high-stage side scroll compressing mechanism 5 can be increased, so that the performance of the multistage compressor 2 is improved.

Second Embodiment

Figure 5:
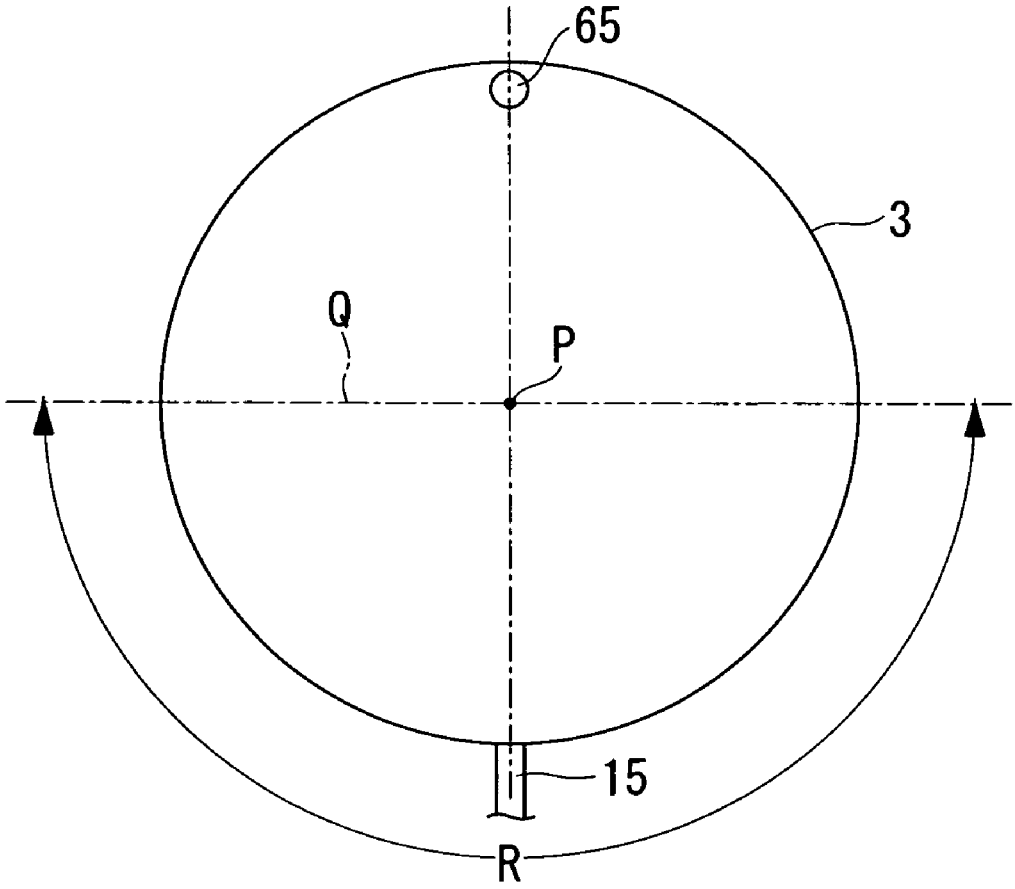
FIG. 5 is a lateral cross-sectional view of a principal portion of the multistage compressor according to a second embodiment of the present invention.

Referring now to FIG. 2 and FIG. 5, a second embodiment of the present invention will be described.

This embodiment is different from the first embodiment in that the point of connection of the gas injection circuit 15 is specified. Other points are the same as the first embodiment, and hence description thereof will be omitted.

In the high-stage side scroll compressing mechanism 5, lubricating oil which has lubricated the required points of lubrication is collected in a recess of the frame member 50, and from this recess, is dropped down to the bottom of the closed housing 3 via an oil discharge hole 65 (see FIG. 2). The gas injection circuit 15 is connected to the closed housing 3 at a position 180° opposite from the oil discharge hole 65 with respect to an axial line P of the crankshaft 34 as shown in FIG. 5.

In this manner, a sufficient distance is secured between the oil discharge hole 65 and the connecting position of the gas injection circuit 15 by connecting the gas injection circuit 15 to the closed housing 3 at a position 180° opposite from the oil discharge hole 65 with respect to the axial line P of the crankshaft 34. Therefore, the refrigerant gas injected into the closed housing 3 can be restrained from coming into contact with the lubricating oil 37 discharged from the oil discharge hole 65 and whirling the lubricating oil 37 upward. Accordingly, unnecessary discharge of the lubricating oil 37 (oil discharge out of the compressor) can be prevented, and lowering of the volumetric efficiency of the high-stage side compressing mechanism 5 by excessive mixing of the lubricating oil 37 into the intermediate pressure refrigerant gas can be also prevented. Therefore, the performance of the CO2 cycle 1 and the multistage compressor 2 can be improved.

The point of connection of the gas injection circuit 15 does not necessarily have to be the position 180° opposite side of the axial line P of the crankshaft 34 from the oil discharge hole 65, but must simply be apart therefrom by a distance which prevents upward whirling of the lubricating oil 37 discharged from the oil discharge hole 65, and must simply be connected to the closed housing 3 at a position opposite side of the axial line P of the crankshaft 34 from the position of the oil discharge hole 65 in a range R defined by a line Q which is orthogonal to the axial line P.

An oil discharge hole may be provided on the low-stage side rotary compressing mechanism 4 as needed, and in this case, the relation with respect to the gas injection circuit 15 is the same as described above.

Third Embodiment

Figure 6:
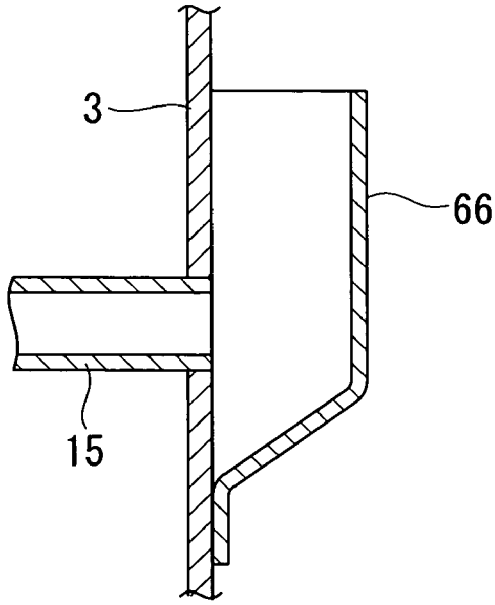
FIG. 6 is a vertical cross-sectional view of a principal portion of the multistage compressor according to a third embodiment of the present invention.

Referring now to FIG. 6, a third embodiment of the present invention will be described.

This embodiment is different from the first embodiment in the configuration of a connecting portion of the gas injection circuit 15 connected to the closed housing 3. Other points are the same as the first embodiment, and hence description thereof will be omitted.

In this embodiment, as shown in FIG. 6, a shielding panel 66 for covering an opening of the gas injection circuit 15 at a predetermined distance is provided inside the closed housing 3 so as to oppose the point of connection of the gas injection circuit 15 to the closed housing 3.

With the provision of the shielding panel 66 as described above, refrigerant gas injected from the gas injection circuit 15 into the closed housing 3 and the lubricating oil 37 dropped down into the closed housing 3 after having lubricated the compressing mechanism 5 are separated from each other, and hence the lubricating oil 37 is prevented from whirling upward by the injected refrigerant gas.

Therefore, unnecessary discharge of oil discharged out of the compressor 2 due to the lubricating oil 37 mixed into the refrigerant gas can be prevented, and lowering of volumetric efficiency of the high-stage side compressing mechanism 5 by excessive mixing of the lubricating oil into the intermediate pressure refrigerant gas can be prevented, so that the performance of the multistage compressor 2 is improved.

Fourth Embodiment

Figure 7:
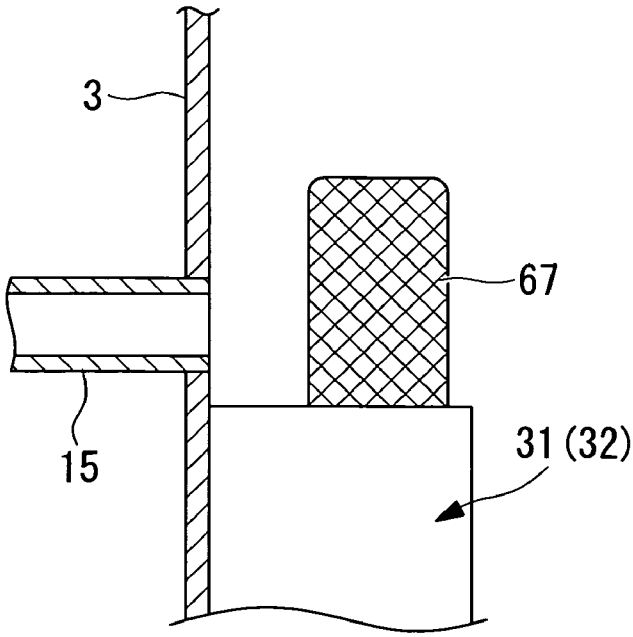
FIG. 7 is a vertical cross-sectional view of a principal portion of the multistage compressor according to a fourth embodiment of the present invention.

Referring now to FIG. 7, a fourth embodiment of the present invention will be described.

This embodiment is different from the first embodiment in the configuration of the connecting portion of the gas injection circuit 15 connected to the closed housing 3. Other points are the same as the first embodiment, and hence description thereof will be omitted.

In this embodiment, as shown in FIG. 7, the gas injection circuit 15 is connected to the closed housing 3 at a position opposing a stator coil end 67 of the electric motor 31.

As described above, by connecting the gas injection circuit 15 so as to oppose the stator coil end 67 of the electric motor 31, refrigerant gas injected into the closed housing 3 and the lubricating oil dropped down into the closed housing 3 after having lubricated the compressing mechanism 5 are separated from each other, and hence the lubricating oil can be prevented from whirling upward by the injected refrigerant gas using the stator coil end 67.

Accordingly, unnecessary discharge of oil discharged out of the compressor 2 due to the lubricating oil 37 mixed into the refrigerant gas can be prevented, and lowering of volumetric efficiency of the high-stage side compressing mechanism 5 by excessive mixing of the lubricating oil into the intermediate pressure refrigerant gas can be prevented, so that the performance of the multistage compressor 2 is improved. In addition, since the motor stator 32 is cooled by the injected refrigerant gas, the motor efficiency can be improved.

Fifth Embodiment

Figure 8:
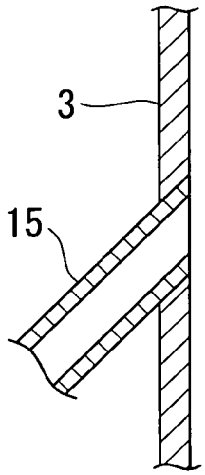
FIG. 8 is a vertical cross-sectional view of a principal portion of the multistage compressor according to a fifth embodiment of the present invention.

Referring now to FIG. 8, a fifth embodiment of the present invention will be described.

This embodiment is different from the first embodiment in the configuration of the connecting portion of the gas injection circuit 15 connected to the closed housing 3. Other points are the same as the first embodiment, and hence description thereof will be omitted.

In this embodiment, as shown in FIG. 8, the gas injection circuit 15 is connected to the closed housing 3 toward obliquely upward from below, so that the injected refrigerant gas is directed toward the high-stage side scroll compressing mechanism 5.

As described above, by connecting the gas injection circuit 15 to the closed housing 3, refrigerant gas injected into the closed housing 3 is taken into the high-stage side scroll compressing mechanism 5 without bringing into much contact with the lubricating oil 37 which drops down into the closed housing 3 after having lubricated the high-stage side scroll compressing mechanism 5. Therefore, the lubricating oil can be prevented from whirling upward by the injection gas.

Therefore, unnecessary discharge of oil discharged out of the compressor 2 due to the lubricating oil 37 mixed into the refrigerant gas can be prevented, and lowering of volumetric efficiency of the high-stage side compressing mechanism 5 by excessive mixing of the lubricating oil into the intermediate pressure refrigerant gas can be prevented, so that the performance of the multistage compressor 2 is improved.

Sixth Embodiment

Figure 9:
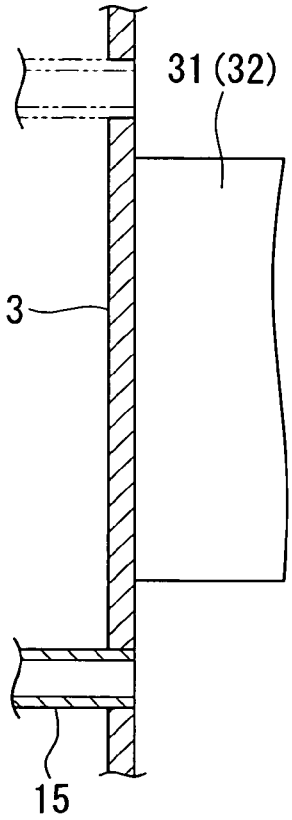
FIG. 9 is a vertical cross-sectional view of a principal portion of the multistage compressor according to a sixth embodiment of the present invention.

Referring now to FIG. 9, a sixth embodiment of the present invention will be descried.

This embodiment is different from the first embodiment in the point of connection of the gas injection circuit 15 connected to the closed housing 3. Other points are the same as the first embodiment, and hence description thereof will be omitted.

In this embodiment, as shown in FIG. 9, the gas injection circuit 15 which is connected to the position shown by a chain line in the first embodiment is connected to the closed housing 3 at a position below the electric motor 31, that is, a position between the electric motor 31 and the low-stage side rotary compressing mechanism 4.

As described above, by connecting the gas injection circuit 15 to the closed housing 3 at a position between the electric motor 31 and the low-stage side rotary compressing mechanism 4, the refrigerant gas injected into the closed housing 3 circulates upward around the electric motor 31, so that the electric motor 31 is cooled by the refrigerant gas.

Accordingly, the motor efficiency is increased, and the performance of the multistage compressor 2 can be improved.

Seventh Embodiment

Figure 10:
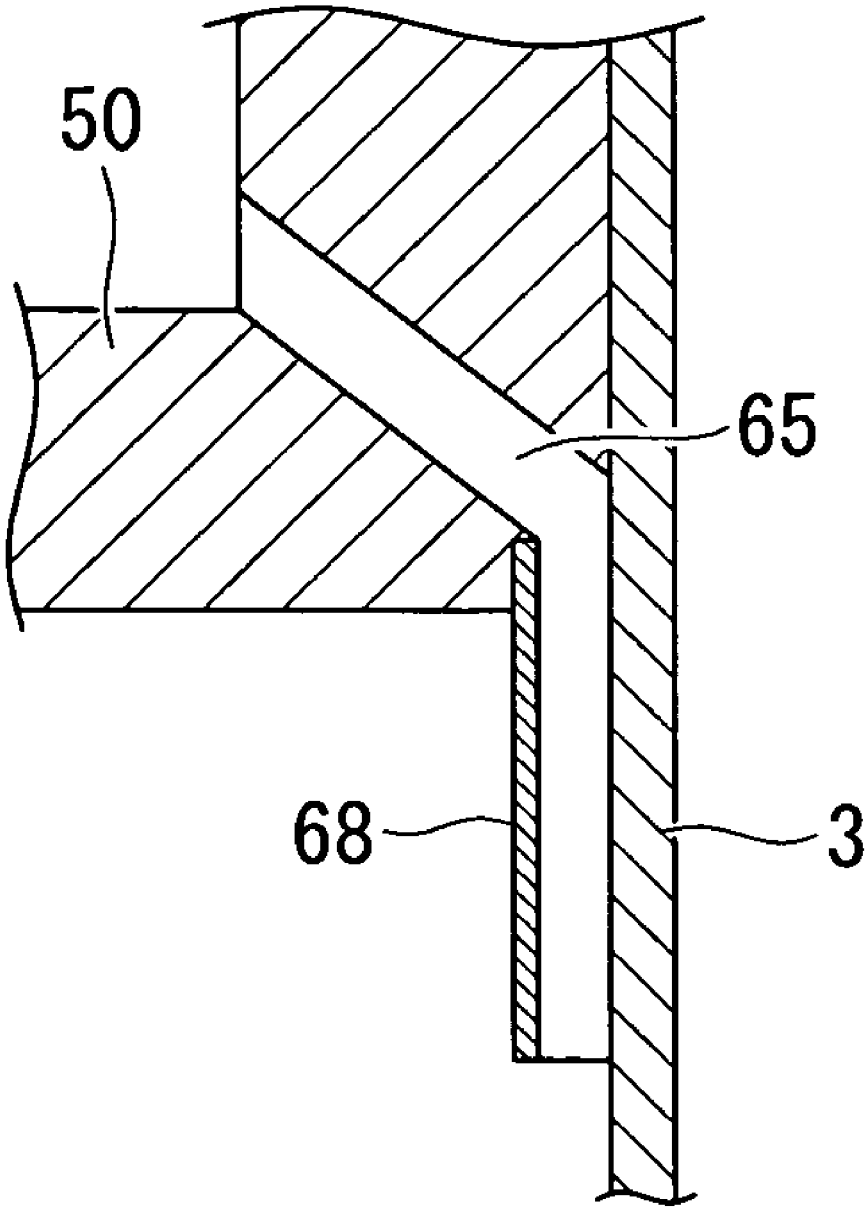
FIG. 10 is a vertical cross-sectional view of a principal portion of the multistage compressor according to a seventh embodiment of the present invention.

Referring now to FIG. 10, a seventh embodiment of the present invention will be described.

This embodiment is different from the first and second embodiments in the configuration of the oil discharge hole 65. Other points are the same as the first and second embodiments, and hence description thereof will be omitted.

In this embodiment, as shown in FIG. 10, an oil discharge guide 68 for guiding discharged oil into an oil trap in the closed housing 3 is provided at the oil discharge hole 65 for discharging lubricating oil after having lubricated the high-stage side scroll compressing mechanism 5 into the closed housing 3.

As described above, by providing the oil discharge guide 68, refrigerant gas injected into the closed housing 3 and the lubricating oil discharged from the oil discharge hole 65 into the closed housing 3 after having lubricated the compressing mechanism 5 are separated from each other, and the lubricating oil can be prevented from whirling upward by the injected refrigerant gas.

Accordingly, unnecessary discharge of oil discharged out of the compressor 2 due to the lubricating oil 37 mixed into the refrigerant gas can be prevented, and lowering of volumetric efficiency of the high-stage side compressing mechanism 5 by excessive mixing of the lubricating oil into the intermediate pressure refrigerant gas can be prevented, so that the performance of the multistage compressor 2 is improved.

The oil discharge guide may be provided also in the case in which the oil discharge hole is provided in the low-stage side rotary compressing mechanism 4.

The present invention is not limited to the embodiments shown above, and may be modified without departing the scope of the present invention.

For example, the system of the CO2 cycle may be of a system in which an internal heat exchanger is provided and the intermediate pressure refrigerant gas extracted from the internal heat exchanger is injected instead of the injection system using the vapor-liquid separator.

The invention claimed is:

1. A multistage compressor for a CO2 cycle that includes a low-stage side rotary compressing mechanism and a high-stage side scroll compressing mechanism driven by an electric motor in a closed housing, and carries out two-stage compression by discharging CO2 refrigerant gas compressed in the low-stage side rotary compressing mechanism into the closed housing and taking intermediate pressure refrigerant gas in the closed housing by the high-stage side scroll compressing mechanism, wherein a gas injection circuit for injecting intermediate pressure CO2 refrigerant gas extracted from a refrigerant circuit into the closed housing is connected to the closed housing, and wherein the pressure ratios of the low-stage side rotary compressing mechanism and the high-stage side scroll compressing mechanism are substantially equivalent, and the ratios of displacement volume are also substantially equivalent.

2. The multistage compressor according to claim 1, wherein the ratios of the displacement volume is 1:0.8 to 1:1.

3. The multistage compressor according to claim 1, wherein the low-stage side rotary compressing mechanism is provided on one side of the electric motor provided at a center portion of the closed housing so as to be connected to a crank portion provided at one end of a drive shaft driven by the electric motor, and the high-stage side scroll compressing mechanism is provided on the other side of the electric motor so as to be connected to a crank pin portion provided at the other end of the drive shaft.

4. The multistage compressor according to claim 1, wherein the low-stage side rotary compressing mechanism and the high-stage side scroll compressing mechanism are provided with an oil supply pump for supplying lubricating oil filled in the closed housing to required points of lubrication via oil supply holes provided in the drive shafts thereof, and the oil supply pump is a positive displacement oil supply pump.

5. The multistage compressor according to claim 1, wherein the gas injection circuit is connected to the closed housing at a position on the opposite side of the axial line of the drive shaft of the compressing mechanism from the position of an oil discharge hole through which the lubricating oil after having lubricated the compressing mechanism is discharged in the range defined by a line orthogonal to the axial line of the drive shaft.

6. The multistage compressor according to claim 1, wherein a shielding panel is provided in the closed housing so as to oppose to an opening of the gas injection circuit toward the interior of the closed housing.

7. The multistage compressor according to claim 1, wherein the gas injection circuit is connected to and opening toward the interior of the closed housing at a position opposing a stator coil end of the electric motor.

8. The multistage compressor according to claim 1, wherein the gas injection circuit is connected to and opened toward the interior of the closed housing obliquely toward the high-stage side scroll compressing mechanism.

9. The multistage compressor according to claim 1, wherein the high-stage side scroll compressing mechanism includes an oil discharge hole for discharging the lubricating oil after having lubricated required points into the closed housing, and the oil discharge hole is provided with an oil discharge guide for guiding the discharged oil into an oil trap in the closed housing.

10. The multistage compressor according to claim 1, wherein the gas injection circuit is connected to and opening toward the interior of the closed housing at a position between the electric motor and the high-stage side scroll compressing mechanism.

11. The multistage compressor according to claim 1, wherein the gas injection circuit is connected to and opening toward the interior of the closed housing at a position between the electric motor and the low-stage side rotary compressing mechanism.

* * * * *